US007896521B2

(12) United States Patent
Becker et al.

(10) Patent No.: US 7,896,521 B2
(45) Date of Patent: Mar. 1, 2011

(54) ADJUSTABLE LIGHT DISTRIBUTION SYSTEM

(75) Inventors: Aaron James Becker, Covington, GA (US); Jeffrey Mansfield Quinlan, Covington, GA (US)

(73) Assignee: ABL IP Holding LLC, Conyers, GA (US)

( * ) Notice: Subject to any disclaimer, the term of this patent is extended or adjusted under 35 U.S.C. 154(b) by 263 days.

(21) Appl. No.: 12/115,197

(22) Filed: May 5, 2008

(65) Prior Publication Data

US 2008/0273324 A1 Nov. 6, 2008

Related U.S. Application Data

(60) Provisional application No. 60/927,690, filed on May 4, 2007, provisional application No. 60/916,280, filed on May 5, 2007, provisional application No. 60/916,398, filed on May 7, 2007.

(51) Int. Cl.
*F21V 5/00* (2006.01)

(52) U.S. Cl. ..... 362/244; 362/240; 362/239; 362/326

(58) Field of Classification Search ..... 362/244, 362/287, 282, 311.02–311.1, 326, 330–332, 362/236–239, 249.02–249.07, 97.3, 240
See application file for complete search history.

(56) References Cited

U.S. PATENT DOCUMENTS 5,528,474 A 6/1996 Roney et al.
5,690,417 A 11/1997 Polidor et al.
5,806,969 A 9/1998 Rosengren
5,836,676 A * 11/1998 Ando et al. ..... 362/244
5,893,626 A 4/1999 Poling
6,048,080 A 4/2000 Belliveau
6,386,743 B1 5/2002 Futami et al.
6,390,643 B1 5/2002 Knight
6,454,437 B1 9/2002 Kelly
6,478,447 B2 11/2002 Yen
6,502,956 B1 1/2003 Wu
6,554,451 B1 4/2003 Keuper
6,657,393 B2 12/2003 Natsume
6,773,139 B2 8/2004 Sommers
6,908,214 B2 6/2005 Luk
7,204,610 B2 4/2007 Watanabe et al.
7,226,185 B2 * 6/2007 Dolgin et al. ..... 362/239
7,278,755 B2 10/2007 Inamoto
7,284,871 B2 10/2007 Oon et al.
7,331,681 B2 * 2/2008 Pohlert et al. ..... 362/18
2006/0092636 A1 5/2006 Potucek et al.
2006/0291204 A1 12/2006 Marka et al.
2007/0091602 A1 4/2007 Van Voorst Vader et al.
2007/0097681 A1 5/2007 Chich et al.
2007/0263408 A1 * 11/2007 Chua ..... 362/612
2008/0042068 A1 2/2008 Nishinaga et al.
2008/0101063 A1 5/2008 Koike et al.
2008/0151542 A1 6/2008 Liddle

* cited by examiner

*Primary Examiner*—Robert J May
(74) *Attorney, Agent, or Firm*—Kilpatrick Townsend & Stockton LLP

(57) ABSTRACT

A lighting assembly having a plurality of light sources and a lens matrix having a plurality of lenses. The lens matrix may be positioned relative to the light sources so that each light source resides in a first orientation within one of the lenses and emits a light distribution. Relative translation between the light sources and the lens matrix alters the orientation of the light sources within the lenses, creating a different light distribution. A light source's orientation may change within the same lens, or the light source may translate to a different lens to alter the distribution of its emitted light.

22 Claims, 4 Drawing Sheets

ADJUSTABLE LIGHT DISTRIBUTION SYSTEM

CROSS REFERENCE TO RELATED APPLICATIONS

This application claims the priority of U.S. provisional application Ser. No. 60/927,690, entitled "Lens Matrix", filed May 4, 2007, U.S. provisional application Ser. No. 60/916,280, entitled "Lens Matrix II," filed May 5, 2007, and U.S. provisional application Ser. No. 60/916,398, entitled "Lens Matrix III," filed May 7, 2007, the entire contents of each of which are hereby incorporated by this reference.

BACKGROUND OF THE INVENTION

Consumers demand that lighting systems be as efficient as possible. The systems are typically strategically positioned to illuminate specific areas using as little energy as possible. As such, designers and manufacturers have looked to harness and utilize as much of the light emitted from the lighting systems as possible. One such way is to provide lenses that direct the light on only those areas desired to be lit. For example, it is desirable for a light fixture positioned in the middle of a parking lot to symmetrically direct light downwardly into the lot. Such is not the case with respect to a lighting fixture positioned on the periphery of a parking lot, however. Rather than directing all of the light symmetrically downwardly (in which case half of the light would not be directed onto the parking lot), it is desirable that all of the light emitted from the fixture be focused toward the parking lot.

Lighting manufacturers have responded to the need for versatility in lighting distribution by providing individual, removable lenses that may be associated with a light source. Each lens distributes the light emitted by the light source in a single pattern. If it is desirable that the light emitted from the light source be directed in a particular direction, the lens may be removed from and re-installed on the light source so that the light is emitted in the same distribution but in a different direction. To the extent that the actual distribution of the light needs to be altered, entirely different lenses must be provided.

SUMMARY

Embodiments of the invention provide a lens matrix capable of creating multiple light distributions with the light emitted from a light source. The lens matrix includes a plurality of lenses. When the lens matrix is positioned over a light source (such as LEDs), the light emitted from the LEDs is directed into the lenses, which in turn emit the light in a particular distribution. The optical properties of the lenses dictate the distribution of the light emitted from the LEDs. The optical properties of all of the lenses can be, but need not be, the same. Rather, some of the lenses may have different optical properties capable of imparting a different light distribution.

In use, the lens matrix is positioned over the LEDs (or other light source(s)) so that the LEDs reside within the lenses at a particular location relative to the lenses. The light emitted by an LED encounters the lens, which in turn directs the light in a certain direction. In this way, the lenses collectively form a distribution of the light emitted by the LEDs. It is possible, however, to change the distribution of the light by translating the lens matrix relative to the LEDs, or vice versa, so that the LEDs' orientation is altered, thereby altering the distribution of light emitted by the LEDs, while the LEDs remain positioned in their respective lenses. Moreover, by further translating the lens matrix relative to the board or vice versa, the LEDs may be moved to reside in an entirely different lens provided with different optical properties that thereby alter the distribution of the light that the LEDs emit.

DETAILED DESCRIPTION

Figure 1:
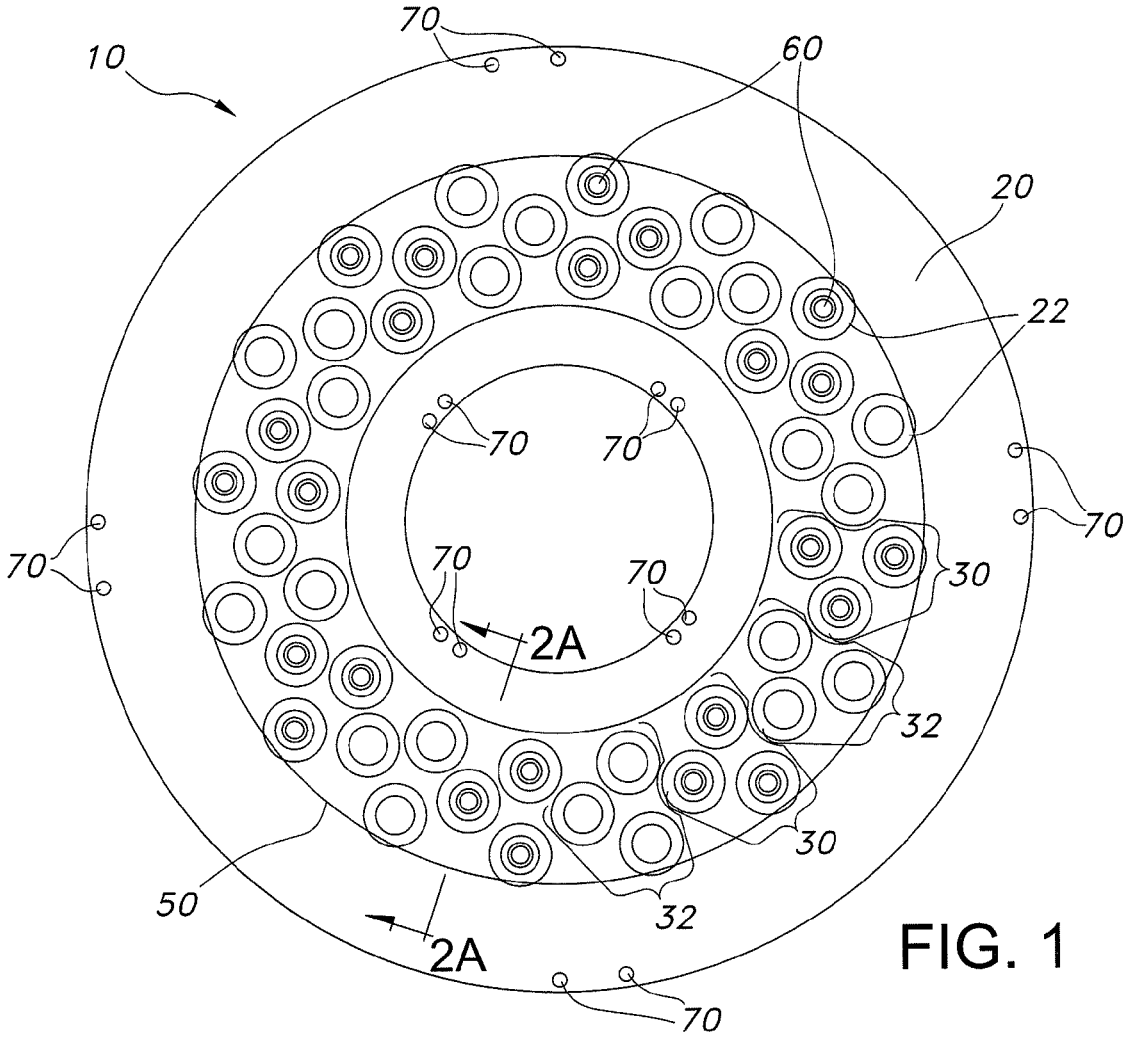
FIG. 1 is a top plan view of a lens matrix according to one embodiment of the invention positioned over an LED circuit board.

Embodiments of the invention provide a lighting system 10 having a lens matrix capable of creating multiple light distributions with the light emitted from a light source. FIG. 1 illustrates a lighting system 10 according to one embodiment of this invention. The lighting system 10 includes a lens matrix 20 positioned over a light source. In the illustrated embodiment, the light source is light emitting diodes ("LEDs") 60 arranged on a circuit board 50. Note, however, that the lens matrix 20 may be used with other types of light sources and is not limited to use with only LEDs 60. Light sources such as, but not limited to, organic LEDs, incandescents, fluorescent, and HIDs may be used. The lens matrix 20 includes a plurality of lenses 22, the undersurface of which define concavities 24. When the lens matrix 20 is positioned on the circuit board 50, the LEDs 60 reside in the concavity 24 of at least some of the lenses 22. When so positioned, the light emitted from the LEDs 60 is directed into the lenses 22, which in turn emit the light in a particular distribution.

The lens matrix 20 and associated lenses 22 are preferably formed of a transparent material. Preferably, the transparent material is a polymeric material, such as, but not limited to, polycarbonate, polystyrene, or acrylic. Use of polymeric materials allows the matrix 20 to be injection-molded, but other manufacturing methods, such as, but not limited to, machining, stamping, compression-molding, etc., may also be employed. While polymeric materials may be preferred, other clear materials, such as, but not limited to, glass, topaz, sapphire, silicone, apoxy resin, etc. can be used to form the lens matrix 20 and associated lenses 22. It is desirable to use materials that have the ability to withstand exposure to a wide range of temperatures and non-yellowing capabilities with respect to ultraviolet light. While the lenses 22 are preferably integrally-formed with the lens matrix 20, they need not be.

The lens matrix 20 of FIG. 1 has a circular shape. The lens matrix 20, however, is not limited to such a shape but rather may come in a variety of different shapes and sizes, as discussed below. Any number of lenses 22 may be provided in the lens matrix 20 and the lenses 22 may be provided in any arrangement on the lens matrix 22, depending on the number and location of the LEDs 60 on the circuit board 50 as well as the number of options of different light distributions desired to be provided.

The optical properties of the lenses 22 dictate the distribution of the light emitted from the LEDs 60. The optical properties of all of the lenses 22 can be, but need not be, the same. Rather, some of the lenses 22 may have different optical properties capable of imparting a different light distribution. By way only of example, the lens matrix 20 of FIG. 1 includes a first set of lenses 30 that create a first light distribution and a second set of lenses 32 that create a second light distribution.

Figure 4:
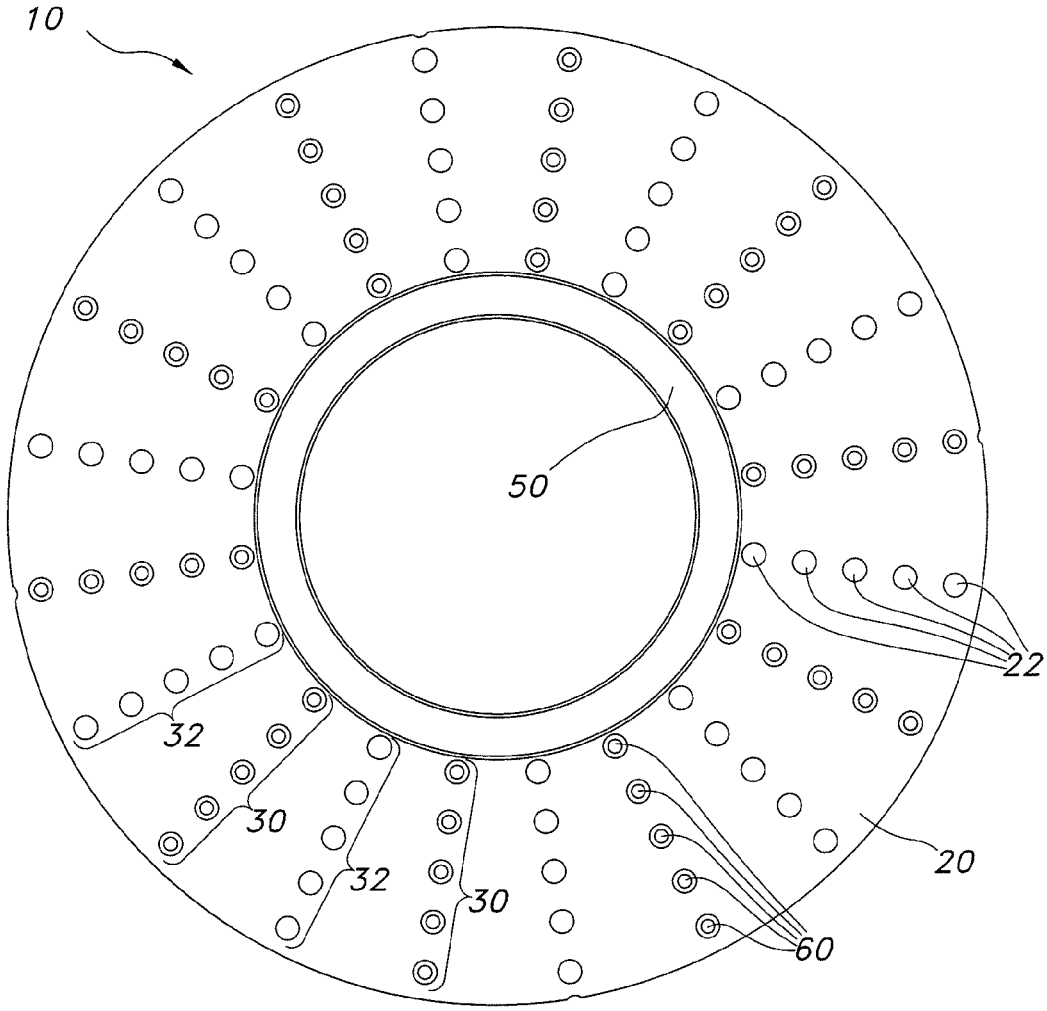
FIG. 4 is a top plan view of an alternative embodiment of a lens matrix positioned over an LED circuit board.
Figure 5:
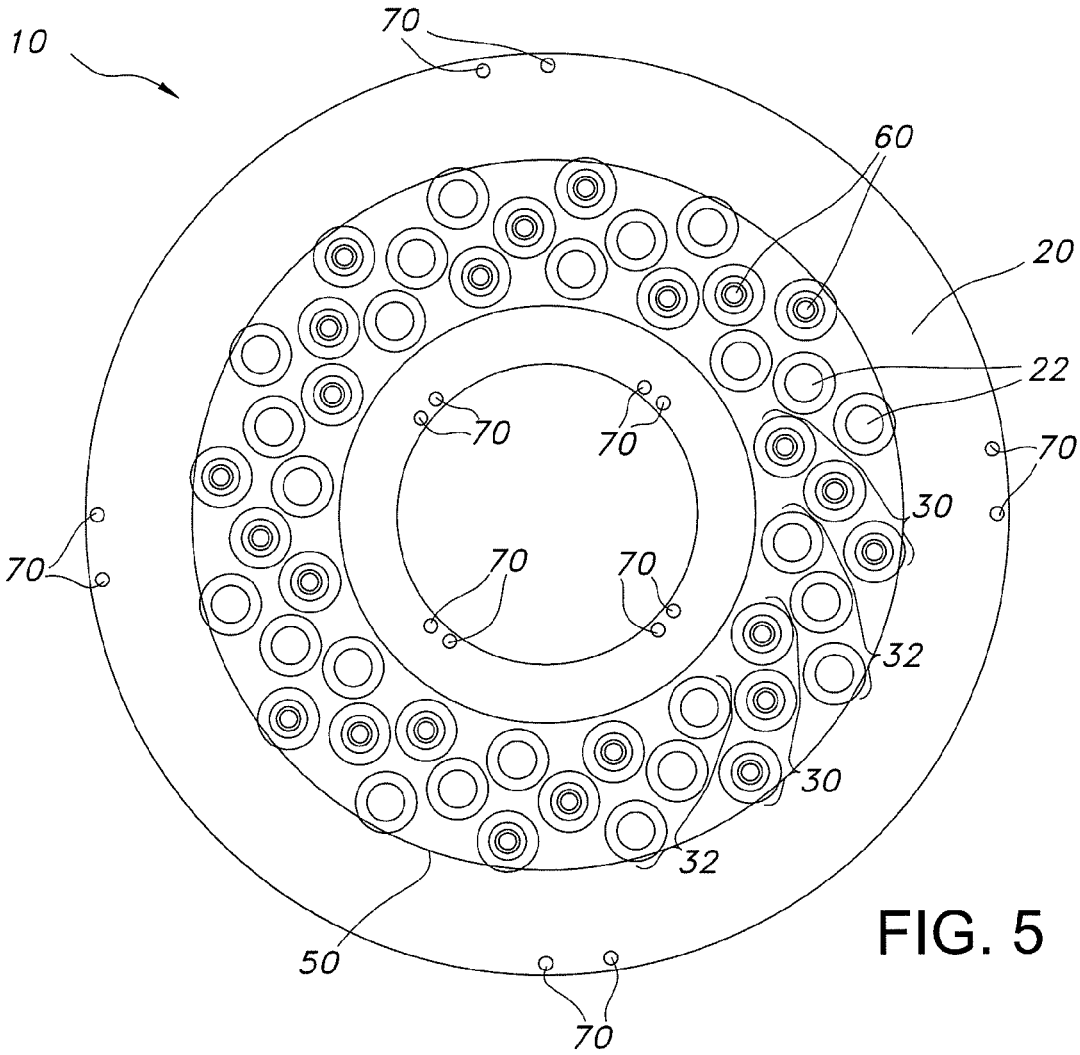
FIG. 5 is a top plan view of yet another embodiment of a lens matrix positioned over an LED circuit board.

While the illustrated sets of lenses 30 and 32 each includes three lenses 22 arranged in a triangular pattern, the sets may include any number of lenses and be arranged on the lens matrix in any pattern to align with the LEDs, including, but not limited to, radially (see FIG. 4), diagonally (see FIG. 5), etc. Moreover, more than two sets of lenses may be used that impart additional different light distributions. Again, however, the number and positioning of the lenses on the lens matrix to accommodate various light sources would be known to one of skill in the art.

In use, the lens matrix 20 is positioned over the circuit board 50 so that the LEDs 60 on the board are positioned within at least some of the lenses 22. The lens matrix 20 is then secured in place relative to the circuit board 50 via any type of mechanical retention device. By way only of example, the lens matrix 20 and board 50 may be provided with fastener holes 70. A fastener (not shown), such as a screw, may be inserted through such holes 70 to secure the lens matrix 20 and circuit board 50 together.

When the lens matrix 20 is so positioned on the circuit board 50, the LEDs 60 are positioned at a particular location relative to the lens 22 within which they reside. The light emitted by an LED 60 encounters the lens 22, which in turn directs the light in a certain direction. In this way, the lenses 22 collectively form a distribution of the light emitted by the LEDs 60.

It is possible, however, to change the distribution of the light by translating the lens matrix 20 relative to the board 50 (or the board 50 relative to the lens matrix 20). To do so, the fastener(s) retaining the lens matrix 20 in place relative to the circuit board 50 is removed or loosened, permitting relative movement between the lens matrix 20 and the circuit board 50.

Figure 2A:
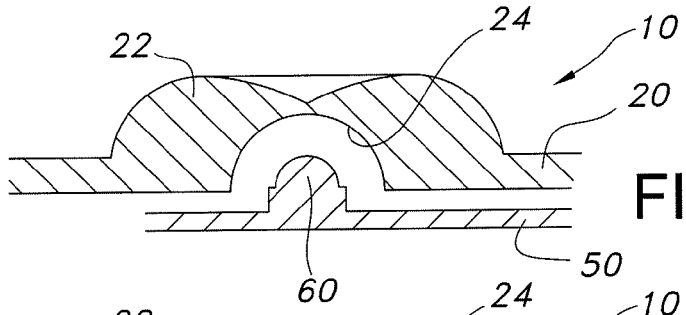
FIG. 2A is a cross-sectional view taken along line 2A-2A of FIG. 1.
Figure 2B:
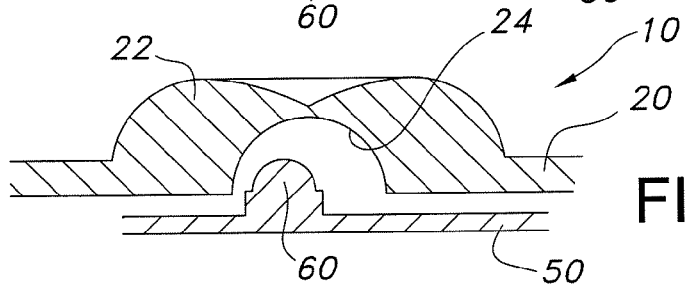
FIG. 2B is a cross-sectional view taken along line 2A-2A of FIG. 1 after relative translation between the lens matrix and an LED on the LED circuit board.
Figure 3A:
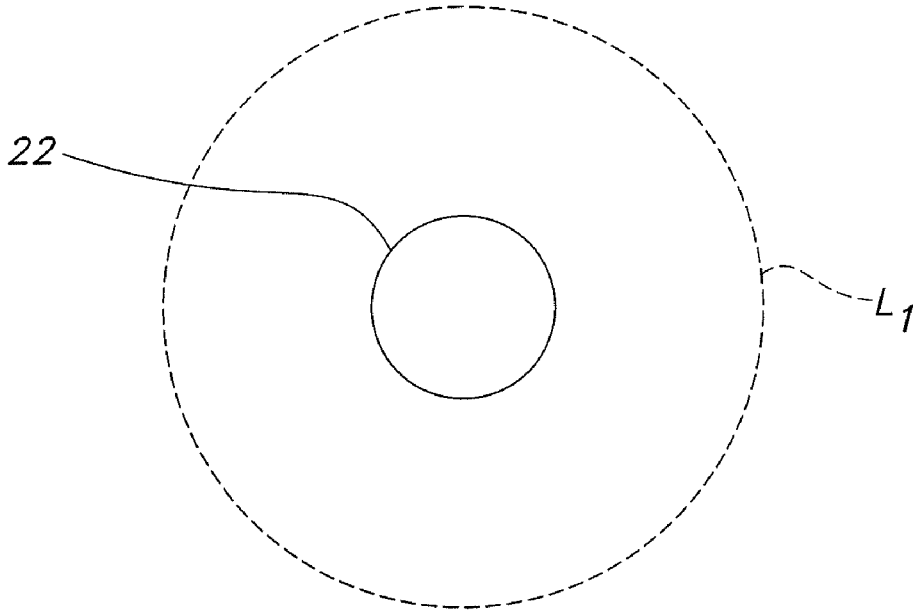
FIG. 3A is a schematic view of a light distribution through a lens on one embodiment of a lens matrix.
Figure 3B:
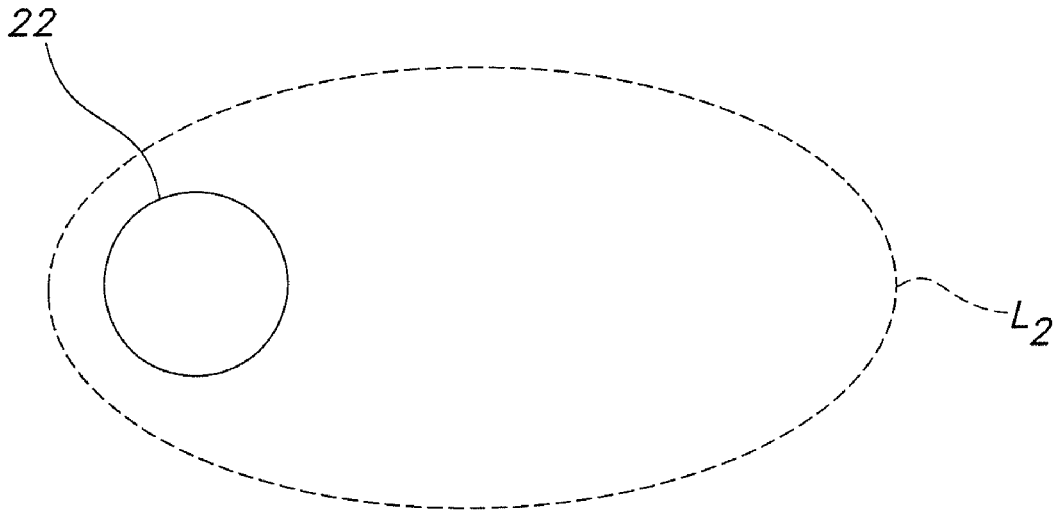
FIG. 3B is a schematic view of an alternative light distribution through the lens shown in FIG. 3A.

By translating the lens matrix 20 relative to the board 50 or vice versa (such as via rotational movement) a relatively minimal amount, the LEDs 60 remain positioned in their respective lenses 22 but orientation of the LEDs 60 within those lenses 22 can be altered and thereby alter the distribution of the light that they emit. FIGS. 2A and 2B illustrate this concept. FIG. 2A shows an LED 60 positioned in the middle of a lens 22, which creates a light distribution $L_1$ such as that shown in FIG. 3A. In FIG. 2B, the LED 60 has been translated within the lens 22 to be positioned closer to the edge of the lens 22. Such re-positioning, in turn, can result in a different light distribution $L_2$, such as that shown in FIG. 3B.

By translating the lens matrix 20 relative to the board 50 or vice versa (such as via rotational movement) a more significant amount, the LEDs 60 may be moved to reside in an entirely different lens 22 provided with different optical properties that thereby alter the distribution of the light that the LEDs 60 emit. So, for example, while the LEDs 60 might have originally been positioned in lens sets 30 in FIG. 1, after translation they reside in lens sets 32. They can obviously be re-oriented via translation within lens sets 32 to further alter the light distribution, as discussed above (and as shown in FIGS. 2A-2B). If fasteners are used to secure the lens matrix 20 in place relative to the circuit board 50, obviously enough holes 70 must be provided to allow securing of the lens matrix 20 to the circuit board in a variety of rotational orientations. For example, if there are three different lens sets, there needs to be sets of three securing holes 70. Alternatively, elongated slots (instead of discrete holes) may be provided so that a fastener positioned in the slot may be secured in various locations along the slot's length.

The lens matrix 20 and circuit board 50 may be provided with any number of complementary features to guide the desired translation. By way only of example, a track may extend from either the upper surface of the circuit board 50 or lower surface of the lens matrix 20 and be received in a complementary slot provided in the other of the upper surface of the circuit board 50 or lower surface of the lens matrix 20. Alternatively, it is also conceivable to wrap the edges of the lens matrix 20 downwardly to form a lip in which the circuit board 50 may be retained and translate. Upstanding arms may extend from either the upper surface of the circuit board 50 or lower surface of the lens matrix 20 and be received in a complementary aperture provided in the other of the upper surface of the circuit board 50 or lower surface of the lens matrix 20. Engagement of the arms within the apertures signals the desired positioning of the LEDs 60 relative to the lenses 22.

Figure 6:
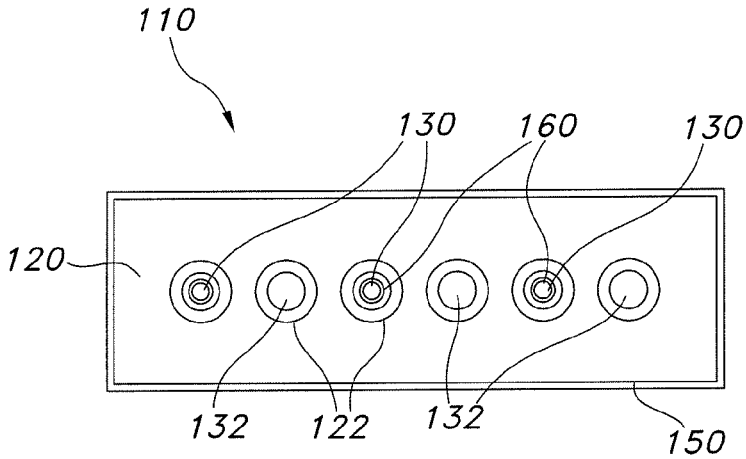
FIG. 6 is a top plan view of still another embodiment of a lens matrix positioned over an LED circuit board.

While FIG. 1 illustrates a circular lens matrix 20, the lens matrix 20 may be of any shape to compliment the LED circuit board. FIG. 6 illustrates a lighting system 110 with a rectilinear lens matrix 120 having a plurality of lenses 122 distributed along its length and positioned over and secured in place relative to an LED circuit board 150 provided with a number of LEDs 160. Again, however, any number of LEDs 160 in any orientation may be provided on the circuit board 150. The LEDs 160 reside within at least some of the lenses 122. As explained above, by merely loosening the connection of the lens matrix 120 to the board 150 and translating the board 150 and lens matrix 120 relative to each other (such as via linear and/or lateral movement), the orientation of the LEDs 160 relative to the lenses 122 can be altered to change the light distribution.

Moreover, as with the embodiment of FIG. 1, the lens matrix may include lenses having different optical properties. For example, the lens matrix 120 of FIG. 6 includes two lens sets 130 and 132, the lenses 122 of one set 130 creating a light distribution different from that created by the other set 132. By translating the circuit board 150 and lens matrix 120 relative to each other (such as via linear and/or lateral movement), the LEDs 160 may be moved to reside in an entirely different lens 122 provided with different optical properties that thereby alter the distribution of the light that the LEDs 160 emit. The lens matrix 120 may then be re-secured to the circuit board 150 to retain the orientation of the LEDs 160 relative to the lenses 122 in the desired position.

The particular optical properties of the lenses of the lens matrix is not critical to embodiments of the invention. Rather, the lenses may be shaped to have any optical properties that impart the desired light distribution(s). One of skill in the art would understand how to impart such properties to the lenses to effectuate the desired light distribution. That being said, it may be desirable, but certainly not required, to shape and position the lenses to facilitate capture and direction of light emitted from a light source. The LED light sources emit light 180 degrees about their source. This makes it difficult to gather this light with only one optical feature i.e. a lens or reflector. The use of a single lens or reflector means a sacrifice in the amount of light collected or a lack of control of that light. So alternatively, or in addition, in some embodiments, the inside curvature of the lens is meant to be a concave hemisphere to minimize reflections to absolutely the least possible amount. The concave hemisphere captures as much of the LED's light as possible. Moreover, the LED may be positioned deep within the lens to insure that almost all the LED's light is captured and makes it into the optic curvature of the lens.

The foregoing has been provided for purposes of illustration of an embodiment of the present invention. Modifications and changes may be made to the structures and materials shown in this disclosure without departing from the scope and spirit of the invention.

What is claimed is:

1. A lighting assembly comprising:

a) a plurality of light sources; and b) a lens matrix comprising a plurality of lenses, wherein the lens matrix is integrally-formed, and wherein the lens matrix is positioned relative to the light sources so that each light source resides in a first orientation within one of the lenses to create a first light distribution, wherein at least one of the light sources or the lens matrix is adapted to translate relative to the other of the light sources or the lens matrix to thereby alter the orientation of the light sources within the lenses to a second orientation to create a second light distribution, wherein the second light distribution is different from the first light distribution.

2. The lighting assembly of claim 1, wherein the light sources comprise light emitting diodes.

3. The lighting assembly of claim 2, wherein the light emitting diodes are mounted on a circuit board and wherein the lens matrix is mechanically retained in position on the circuit board.

4. The lighting assembly of claim 1, wherein the lens matrix comprises transparent material.

5. The lighting assembly of claim 1, wherein the lens matrix comprises polymeric material.

6. The lighting assembly of claim 5, wherein the lens matrix comprises polycarbonate or acrylic.

7. The lighting assembly of claim 1, wherein the lens matrix is circular.

8. The lighting assembly of claim 5, wherein the at least one of the light sources or the lens matrix is adapted to translate via rotational movement.

9. The lighting assembly of claim 1, wherein the lens matrix is rectilinear.

10. The lighting assembly of claim 8, wherein the at least one of the light sources or the lens matrix is adapted to translate via at least one of linear or lateral movement.

11. The lighting assembly of claim 1, wherein the lens matrix is mechanically retained relative to the light sources.

12. The lighting assembly of claim 1, wherein the lenses comprise optical properties and wherein at least some of the lenses in the lens matrix comprise optical properties different from the optical properties of other of the lenses in the lens matrix.

13. A lighting assembly comprising:

a) a lens matrix comprising:

i. a first set of lenses having optical properties; and ii. a second set of lenses having optical properties different from the optical properties of the first set of lenses, wherein the first set of lenses, the second set of lenses, and the lens matrix are integrally-formed;

c) a plurality of light sources, wherein the light sources reside in the first set of lenses to create a first light distribution, wherein at least one of the light sources or the lens matrix is adapted to translate relative to the other of the light sources or the lens matrix such that the light sources reside in the second set of lenses to create a second light distribution, wherein the second light distribution is different from the first light distribution.

14. The lighting assembly of claim 13, wherein the lenses of the first set of lenses and the second set of lenses are arranged in a triangular pattern on the lens matrix.

15. The lighting assembly of claim 13, wherein the lenses of the first set of lenses and the second set of lenses are arranged in a linear pattern on the lens matrix.

16. The lighting assembly of claim 13, wherein the light sources comprise light emitting diodes.

17. The lighting assembly of claim 13, wherein the lens matrix is circular.

18. The lighting assembly of claim 17, wherein the at least one of the light sources or the lens matrix is adapted to translate via rotational movement.

19. The lighting assembly of claim 13, wherein the lens matrix is rectilinear.

20. The lighting assembly of claim 19, wherein the at least one of the light sources or the lens matrix is adapted to translate via at least one of linear or lateral movement.

21. A method of altering a light distribution of light sources comprising:

a. providing a lens matrix comprising a plurality of lenses integrally-formed with the lens matrix;

b. positioning the lens matrix relative to a plurality of light sources so that each light source resides in a first orientation within one of the lenses to create a first light distribution; and c. translating one of the light sources or the lens matrix relative to the other of the light sources or the lens matrix so that each light source resides in a second orientation within one of the lenses to create a second light distribution, wherein the second light distribution is different from the first light distribution.

22. A method of altering a light distribution of light sources comprising:

a) providing a lens matrix comprising:

i. a first set of lenses having optical properties; and ii. a second set of lenses having optical properties different from the optical properties of the first set of lenses; and b) positioning the lens matrix relative to a plurality of light sources so that the light sources reside in the first set of lenses to create a first light distribution;

c) translating one of the light sources or lens matrix relative to the other of the light sources or lens matrix so that the light sources reside in the second set of lenses to create a second light distribution, wherein the second light distribution is different from the first light distribution.

* * * * *